US005142876A

United States Patent [19]

Snider et al.

[11] Patent Number: 5,142,876

[45] Date of Patent: Sep. 1, 1992

[54] METHOD AND APPARATUS FOR HEATING REFRIGERANT IN A CHILLER

[76] Inventors: Darrell R. Snider, 4528 S. Pipkin Rd., Lakeland, Fla. 33811; William C. Richardson, 6810 Spencer Cir., Tampa, Fla. 33610

[21] Appl. No.: 677,476

[22] Filed: Mar. 29, 1991

Related U.S. Application Data

[63] Continuation-in-part of Ser. No. 539,546, Jun. 18, 1990, abandoned.

[51] Int. Cl.[5] ..... F25B 45/00

[52] U.S. Cl. ..... 62/77; 62/149; 62/298

[58] Field of Search ..... 62/77, 125, 126, 127, 62/129, 149, 298, 299, DIG. 17

[56] References Cited

U.S. PATENT DOCUMENTS 3,238,737 3/1966 Shrader et al. ..... 62/149 X 4,862,698 9/1989 Morgan et al. ..... 62/77

4,864,829 9/1989 Manning et al. ..... 62/85

OTHER PUBLICATIONS

Althouse et al., *Modern Refrigeration and Air Conditioning*, The Goodheart-Willcox Co., Inc., 1979, pp. 279-287.

*Primary Examiner*—Albert J. Makay
*Assistant Examiner*—J. Sollecito
*Attorney, Agent, or Firm*—George A. Bode; Michael L. Hoelter

[57] ABSTRACT

An apparatus and method for heating refrigerant in the chiller of a conventional refrigeration system, whereby refrigerant is removed from the chiller and pumped to a heat exchanger, wherein the refrigerant is heated before being returned to the chiller to cause the pressure of the refrigerant in the system to increase. An electrical control structure monitors and controls the pressure and temperature of the refrigerant within the system.

24 Claims, 2 Drawing Sheets

METHOD AND APPARATUS FOR HEATING REFRIGERANT IN A CHILLER

This application is a continuation-in-part application of a previous application by the same inventors bearing U.S. Ser. No. 07/539,546, filed Jun. 18, 1990 now abandoned. The entire previous application, Ser. No. 07/539,546, is incorporated herein by reference as if set forth in full below.

BACKGROUND OF THE INVENTION

1. Field of the Invention

The present invention relates to low pressure chillers of chilled water or chilled brine refrigeration systems and, more particularly, to a method and apparatus for heating and pressurizing the refrigerant in such chillers during removal of fluids; during routine repair or maintenance when the machinery is not running; and, during testing for refrigerant leaks, thereby eliminating the loss of refrigerant (normally a fluoro-chloro hydrocarbon known as FREON ®).

2. General Background

The chiller is the air-tight vessel component of a refrigeration system that contains the refrigerant solution which chills the transfer fluid (normally water) used for subsequent cooling purposes. Inside the chiller, this refrigerant solution is maintained at a very low pressure which results in a low temperature. Preferably, the pressure of the refrigerant (normally FREON ® or, more particularly, R-11 or R-113) results in a vacuum so as to achieve low temperature. The transfer fluid circulates through this refrigerant solution within a serpentine coil until the desired temperature is reached. Afterwards, this transfer fluid is pumped to another location for refrigeration purposes.

In order to repair chillers, or check for leaks, it is necessary in many instances to either remove the refrigerant solution or raise it to ambient pressure. If neither is done, the possibility exists that air will be sucked into the low pressure chiller and mix with the refrigerant. If this happens, the refrigerant must be purged to eliminate the undesirable air. This is a time consuming and expensive operation that almost always results in the escape of a limited, although environmentally unacceptable, amount of refrigerant into the atmosphere. Approaching the problem from the temperature side—by attempting to directly heat a refrigerant such as FREON ®—is unacceptable, as heating a refrigerant (such as R-11, R-12, R-22, R-113, R-500 or R-502) to a high enough temperature can cause "flashing" of the refrigerant which turns (it (changes state) to fosgene gas.

One method and apparatus for raising the pressure of the refrigerant inside the chiller to test for refrigerant leaks is disclosed in U.S. Pat. No. 4,862,698 to Morgan, et al. This patent discloses an auxiliary system (11) that couples to transfer fluid piping (19) outside of the chiller (15). Morgan, et al. '698 diverts this transfer fluid (20) (normally water) to a heater vessel (27) wherein its temperature is raised before being circulated within the cooling circuit (21) of chiller (evaporator) (15), thereby raising the temperature (and hence pressure) of the refrigerant (17) within the chiller (15). While this system will operate, its deficiencies include the fact that the temperature of the first heat transfer medium (liquid 20) is raised by a heat means 29 so that it can then raise the temperature of a second heat transfer medium (the refrigerant (17) within the chiller (15)). Thus, two separate heat exchange operations are required with each involving some degree of inefficiency. Applicants' apparatus and method has but one heat exchange operation, directly heating the refrigerant and increasing the efficiency of the unit. Morgan, et al. '698 will only work if the chilled water or transfer fluid is in the chiller piping (that is, that the chiller's cooling circuit is full of water). This heating of the water in the chiller's cooling circuit thus violates the chilled water circuit. Applicants' device works whether or not there is water or transfer fluid in the chiller's cooling circuit. This is particularly important in northern climates as many chillers are drained of their water and/or have their cooler or condenser heads removed in the cold weather. Morgan, et al. '698 also raises a broad spectrum of problems by having a chilled water diversion system in a high rise building where the pressure head on the chilled water or transfer fluid may reach 200 psi or more. Applicants' apparatus and method is connected to the refrigerant side of the system where the maximum pressure is 15 psi and operates at 18" vacuum to 8 psi (the oil side operates at 0 psi). Further, Morgan, et al. '698 can only heat the chilled water or transfer fluid in this system to its boiling point (212° F. to about 250° F.). Applicants' apparatus and method can heat the oil in the heat exchanger to about 400° F., therefore, heating the refrigerant in the chiller much faster and reach 0 psi or a leak testing pressure much faster. Finally, Morgan, et al. '698 cannot be used to test cooler tubes or condenser tubes since the transfer fluid or water must be circulating to increase the temperature and pressure of the refrigerant.

A method and apparatus for electronically pressure sealing and leak testing an idle centrifugal chiller system are disclosed in U.S. Pat. No. 4,864,829 to Manning, et al. marketed under the name "PRE-VAC" by Mechanical Ingenuity Corp. Basically, Manning, et al. '829 uses the "blanket" approach—heaters glued to a shell, insulation and raising the temperature. A small positive differential pressure is electronically maintained between the interval refrigerant vessel pressure of the chiller system and the ambient atmosphere by selectively applying heat to the refrigerant. Manning, et al. '829 cannot be used on an exiting chiller unless the insulation is first removed, then Manning's device installed and then the insulation reapplied. If the insulation is rubber, Manning's device may melt the rubber or glue used to install the rubber insulation or start it burning. Most chillers come from the manufacturer installed with rubber. Manning's device is an electronic way of blanketing the chiller, whereas applicants' operation is manual. Further, Manning, et al. '829 is not portable.

A heated receiver control for refrigerant systems is disclosed in U.S. Pat. No. 3,238,737 to R. M. Shrader, et al. This device is for use with a high pressure refrigeration system and functions when the system is operating, not when the system is idle or "off." This device's primary use is with low ambient temperature and low load on a high pressure system. It is targeted to keep pressure drop across a metering device so that the system can operate under low load. If this device were heating vapor instead of liquid it could cause the refrigerant to "flash" and thus turn (change state) to fosgene gas. This is why the liquid is in the liquid receiver of the condensor.

U.S. Pat. Nos. 2,169,605 to Griese and No. 4,367,637 to Paulokat are representative of other, non-pertinent, refrigeration testing equipment.

It is thus an object of the present invention to provide a method and apparatus for raising the temperature of a refrigerant in a chiller without the deficiencies described above.

Another object of the present invention is to provide a method and apparatus that does not require two separate heat exchange operations to occur.

A further object of the present invention is to avoid the necessity of coupling to the transfer fluid piping and the need to raise the temperature of the transfer fluid in order to pressurize the refrigerant.

Still another object of the present invention is to provide a means for working on the chiller without the need to subsequently purge the refrigerant (because of its inadvertent mixing with air).

Still another object of the present invention is to reduce the leakage of refrigerant into the atmosphere which not only violates EPA regulations and potentially harms the environment, but also exposes the worker to potentially dangerous fosgene fumes.

still another object of the present invention is to raise the pressure of the refrigerant whether or not the chiller contains water in its cooling circuit.

Still another object of the present invention is to provide a means for pressurizing the chiller so as to allow for "leak testing."

Yet another object of the present invention is to allow leak testing when the chiller is idle or "off."

These and other objects will become obvious upon further investigation.

SUMMARY OF THE PRESENT INVENTION

The preferred embodiment of the apparatus of the present invention solves the aforementioned problems in a straightforward and simple manner. This invention pertains to a method and apparatus for heating a refrigerant contained within the chiller of a conventional refrigeration system for testing refrigerant leaks, removal of fluids, servicing of the equipment or maintaining 0 psi when the system is not running. It includes an alternate line of refrigerant pumped from the cooler through a single heat exchange means configured to warm or heat the refrigerant to atmospheric temperature and pressure. This heat exchange means is connected to the chiller by inlet and outlet piping used to transport the refrigerant between them. The heat exchange means includes a vessel having a sealed concentric heater core having an electric coil immersed in oil therein and baffles for directing refrigerant around the core. Pumping means are supplied to transport this refrigerant for heating purposes with the heating and pumping means being controlled by pressure and temperature controls and monitors.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
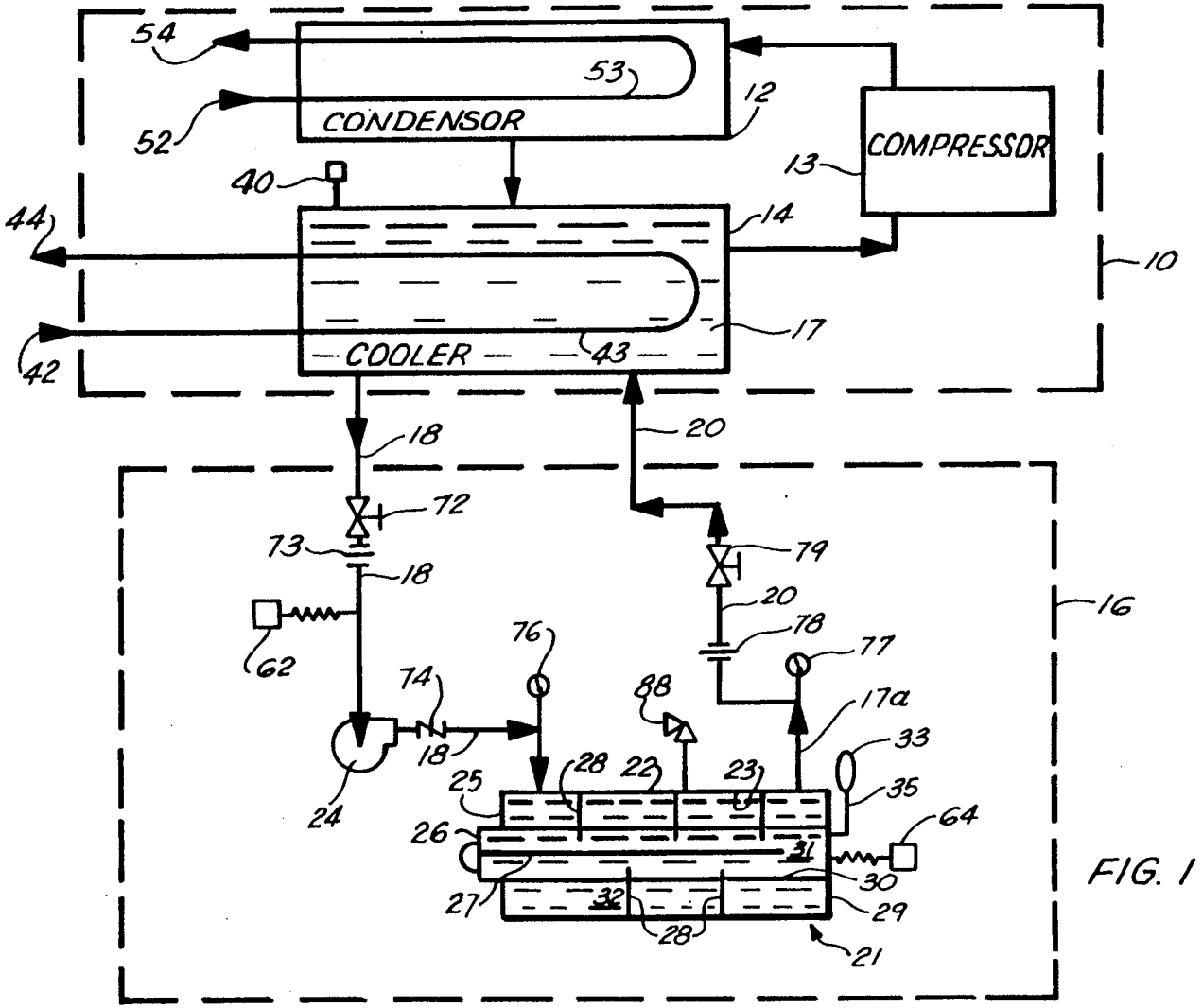
FIG. 1 is a diagrammatic view of a portion of a refrigeration system appended to the preferred embodiment of the present invention, the heat exchange means thereof being in section for better detail.

Referring now to FIG. 1, there is shown a typical chiller 10, such as is used in an air conditioning system, comprising condensor 12 (having a fluid circuit defined by inlet 52, coiled piping 53 and outlet 54), compressor 13, and low pressure cooler or chiller 14 (having a transfer fluid (normally water) circuit defined by inlet 42, coiled piping 43 and outlet 44). Low pressure chiller 10 is preferably a centrifugal chiller with impeller using R11 FREON® (in vacuum at about 14" Hg) as the refrigerant 17. Attached to cooler 14 via inlet and outlet piping 18, 20, respectively, is the apparatus of the present invention refrigerant heating system 16 which, when utilized, heats the refrigerant 17 contained within cooler 14, thereby raising its pressure. Inlet piping 18 (actually outlet piping with respect to cooler 14) connecting systems 10 and 16 includes a valve means 72 (preferably a manually operated ball valve), piping union 73 for "making up" or connecting sections of piping 18, temperature control 62, pump means 24, valve means 74 (preferably a check valve) and pressure gauge 76. Outlet piping 20 (actually inlet piping with regard to cooler 14) includes pressure relief valve 88, pressure gauge 77, piping union 78 and valve means 79 (also, preferably a manually operated ball valve).

As best seen in FIG. 1, refrigerant heating system 16 involves a closed loop that comprises valve controlled inlet and outlet piping 18, 20, respectively coupled between cooler 14 and apparatus vessel or heat exchange means 21 of system 16. When required (by temperature and pressure control means discussed further hereinbelow), the low pressure (and hence low temperature) refrigerant 17 is transferred directly from chiller 10 by means of pump 24 through inlet pipe 18 and into vessel 22 of heat exchange means 21. Refrigerant 32 (renumbered as such within vessel 22) is heated as it flows, in the direction of ARROWS A as influenced by baffles 28, around heater means 26 within vessel 22. Afterwards, heated refrigerant **17*a* (renumbered as such after leaving vessel 22 in line 20) is transferred back to chiller 10, via outlet piping 20, where it recombines with the other uncycled refrigerant 17. This procedure of withdrawing a portion of refrigerant 17 from chiller 10 and raising its temperature before recycling it back is repeated until the temperature rise of the refrigerant 17 in chiller 10 causes its pressure to reach or exceed ambient pressure. (It can now be appreciated that this method can be achieved whether or not transfer fluid is in the cooling circuit 42-43-44 of cooler 14.) When ambient pressure is achieved, work may be instituted on cooler 14 or any other portion of chiller 10, without inadvertently causing air to be sucked into chiller 10 and improperly mixing with the refrigerant. When ambient pressure is exceeded, a pressure leak test may be performed to check for any leaks in chiller 10**.

A variety of gauges and controllers, to be discussed further hereinbelow, monitor the temperature and pressure of the refrigerant both within chiller 10 and within refrigerant heating system 16. These elements help to indicate and control the pressure, volume and temperature of the refrigerant 17-32-17*a* being cycled through inlet and outlet piping 18 and 20 by controlling the operation of pump 24 and heat exchange means 21. Such elements also control the temperature of heating means 26 so as to maintain optimum conditions for raising the pressure of refrigerant 17.

Figure 4:
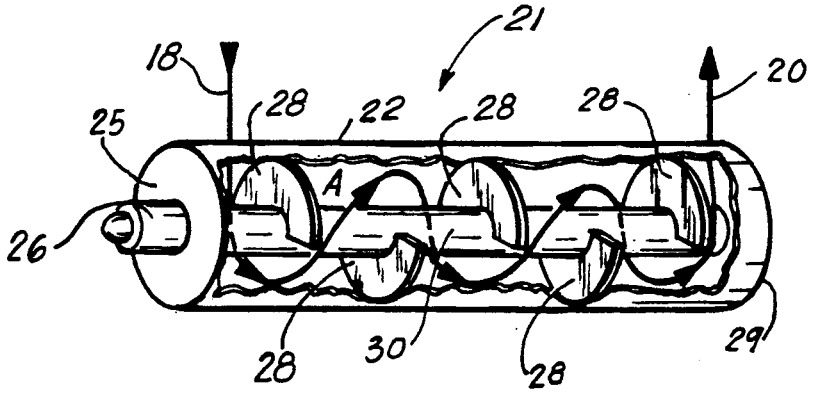

Preferably heat exchange means 21, as best seen in FIGS. 1 and 4, is a sealed electric oil heater having an outer vessel 22 and a sealed core area or inner vessel 30 axially concentric to vessel 22. Inner vessel 30 is filled with oil and refrigerant 32 is pumped into sealed outer concentric chamber 23 of vessel 22. Electric heating element or coil 27 is provided longitudinally and axially of inner chamber 30 within oil bath 31 from proximate end 25 to a distance spaced from distal end 29 of vessel 22. Internal baffles 28, in the form of spaced apart alternating semicircular disks or fins, are positioned in chamber 23 by being mounted on the exterior surface concentric inner core or vessel 30. (Electric heating means 26 is the preferred embodiment, although other types of heat exchangers could also be used). Overflow tank 33 is connected to inner vessel 30 via piping 35 should the pressure in vessel 30 exceed a predetermined safe level. In the typical manner, heating means 26 heats refrigerant 32 that is pumped and circulated around baffles 28 as best seen by ARROWS A in FIG. 4. In an alternate embodiment, refrigerant 32 would flow through a coil that is immersed in a warm bath solution. In any event, refrigerant 17-32-17*a* is contained within a closed loop while its temperature and pressure are regulated as needed and disclosed hereinbelow.

As best seen in FIG. 1, heat exchange means 21 preferably includes a heating element 27 extending into oil bath 31 within core area or inner vessel 30 within chamber 23 of vessel 22. The heating element 27 may be of various typical constructions and its operation will now be apparent to those skilled in the art.

Figure 2:
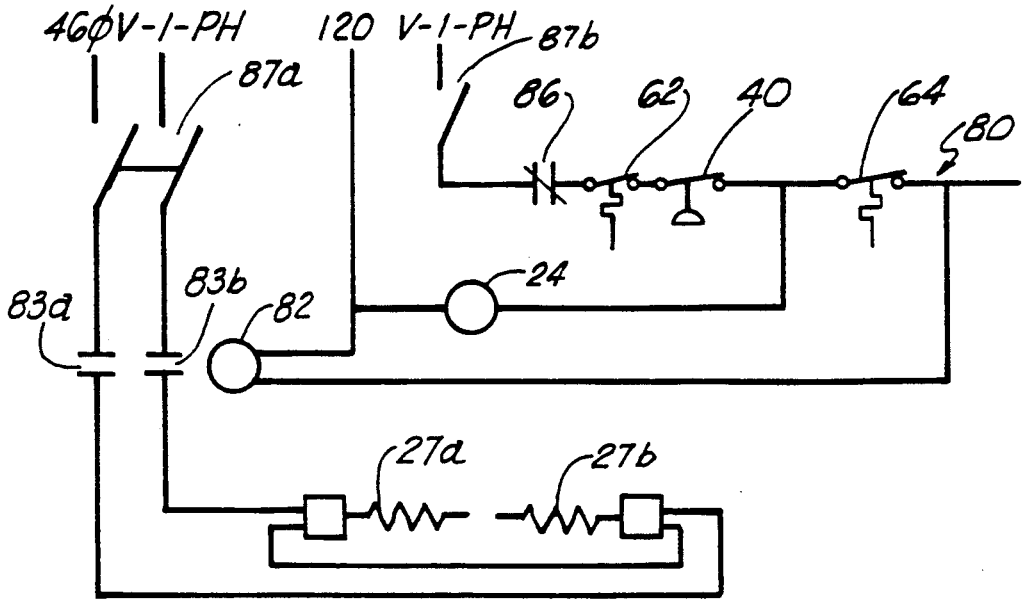
FIG. 2 is a schematic illustration of the electrical control circuitry of the preferred embodiment of the present invention with a 460-Volt application and the heating elements arranged in series.
Figure 3:
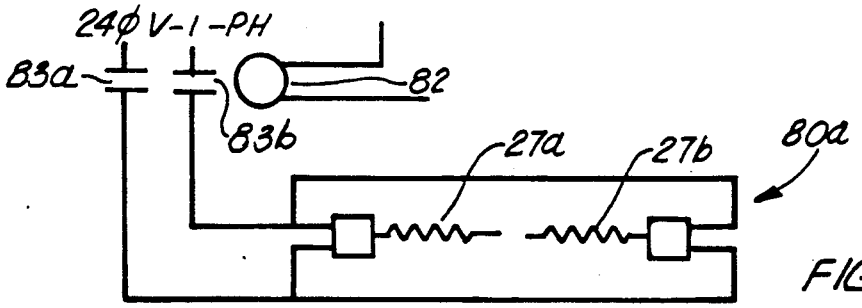
FIG. 3 is a schematic illustration of the electrical control circuitry of the embodiment of FIG. 2, but with a 240-Volt application and the heating elements arranged in parallel; and, FIG. 4 is a top perspective view of the heat exchange means of FIG. 1, with the vessel wall broken away for detail.

As best seen in FIG. 2, systems 10 and 16 preferably include electrical circuit means 80 for controlling the increase in temperature and pressure of the refrigerant 17 within system vessel 14 (FIG. 2 shows a 460 volt/series application; FIG. 3 a 240 volt/parallel application). Returning now to FIG. 1 in conjunction with FIG. 2, the control means preferably includes: a temperature control or temperature actuated switch means 64 in contact with the oil bath 31 for activating and deactivating heating elements 27*a*, 27*b* in response to the temperature of refrigerant 32 within chamber 23 of apparatus vessel 22; a pressure control or pressure actuated switch means 40 in contact with refrigerant 17 in chiller 10 for activating and deactivating pump means 24 and heat elements 27*a*, 27*b* in response to pressure of the refrigerant 17 in system vessel 14; and, a temperature control or temperature actuated switch means 62 in piping 18 intermediate cooler 14 and pump means 24 for activating and deactivating pump means 24 and heating elements 27*a*, 27*b* in response to the temperature of refrigerant 17 in flow line 18. The refrigerant 17 flows into sealed chamber 23 of apparatus vessel 22.

The control means preferably includes a thermostat 62 and first pressure gauge means 76 for monitoring and indicating the temperature and pressure of the refrigerant 17 in piping 18 and flowing into chamber 23 of apparatus vessel 22 and a second thermostat 64 and pressure gauge means 77 (on refrigerant line 20) for maintaining and monitoring the temperature of the oil 31 in core or vessel 30 of apparatus vessel 22 and the pressure of refrigerant 32 as it leaves heat exchange means 21 via refrigerant flow line 20 and pressure control 40 for monitoring and indicating the pressure of refrigerant 17 in chiller 10. The control means also preferably includes manually operated valve 72 and check valve 74 in flow line 18 for controlling the flow of refrigerant 17 therein if the pressure of refrigerant within chamber 23 of apparatus vessel 22 is above a predetermined amount. System 16 includes a pump means 24 for pumping the refrigerant 17 through chamber 23 of apparatus vessel 22 and valve means 79 associated with fluid flow line 20 for controlling the flow of refrigerant 17*a* through flow line 20.

The control means also preferably includes a relay means preferably including a first contact means 86 (a normally closed contact when the chiller 10 is running) coupled to the temperature and pressure actuated switch means 62, 40, 64 for being selectively energized by the manually operated switch 87*b* and a second contact means 82 (a normally open contact) coupled to the control means 83*a*, 83*b*, for being selectively energized by manually operated switch 87*a*.

The apparatus 16 preferably includes electrical circuit 80, best shown in FIG. 2 (460 Volt, series application; in an alternate electrical circuit 80*a*, shown in FIG. 3, there is a 240 Volt, parallel application). Circuit 80 is controlled by manually operated switches 87*a*, 87*b* and coupled to an electrical power supply (not shown).

The method of detecting refrigerant leaks of the present invention (the operation of refrigerant heating system 16) is simple. System vessel 16 is connected to chiller 10 via fluid flow piping or lines 18 and 20. The valve means 72 and 79 are open and switch means 87*a*, 87*b* are closed so that pump means 24 is activated to cause refrigerant 17, 32, 17*a* to be pumped through chamber 23 of apparatus vessel 22. Heating elements 27*a*, 27*b* of heating means 26 are thus activated to heat refrigerant 32 within vessel 22 and thereby transfer heat to refrigerant 17 within chiller 10, whereby the pressure of refrigerant 17 within chiller 10 will increase as will now be apparent to those skilled in the art. Refrigerant chiller 10 is then tested for refrigerant leaks in a typical manner while the control means control the temperature and increase in pressure of refrigerant 17 within chiller 10.

To summarize the operation of the preferred embodiment, with chiller 10 idle or "off" (if the chiller 10 were running and the pressure were raised, it would not chill the transfer fluid), and with valves 72, 79 open, and switches 87*a*, 87*b* closed, and with pressure activated switch means 40 set at a predetermined pressure, and with thermostat 64 at oil bath 31 set at a predetermined temperature, the control means or contact relay 86 will close the first control means 62, 40 and energize pump means 24 and cause refrigerant 17 to be pumped through flow lines 18 and 20 and heat exchange means 21, and close the second control means 64 thus maintaining contact means 82 and control means 83*a*, 83*b* to energize the heating elements 27*a*, 27*b*. Thermostat 64 will thus energize and deenergize (cycle) heating elements 27*a*, 27*b* to maintain the desired temperature until pressure actuated switch 40 opens (is satisfied) stopping pump 24 and heating elements 27*a*, 27*b* will be deenergized.

An alternate embodiment involves the utilization of a separate pair of chillers 10, each one connected to refrigerant heating system 16. In this fashion, one chiller can be in use while the other chiller is taken out of service for repair without shutting down the entire refrigeration system. Obviously, the out-of-service chiller would have its refrigerant pressure raised to ambient pressure or beyond by circulating, and thus warming it, via pump means 24 and heat exchange means 21. In this fashion, the risk of sucking air into a low pressure chiller is significantly reduced.

Yet another embodiment of this invention involves the use of a portable refrigerant heating system 16 that temporarily connects to chiller 10 as needed. In this fashion, only one system 16 would be needed to service a variety of chillers 10 without incurring the expense of multiple fixed systems 16.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An apparatus for heating the refrigerant in a refrigeration system including a system vessel having said refrigerant therein, comprising:

(a) heat exchange means for heating said refrigerant therein, said heat exchange means comprising:
  i. an apparatus vessel having an inner vessel therein, thereby forming a chamber therebetween, said inner vessel containing a fluid heat transfer medium therein; and,
  ii. a heating element provided in said inner vessel, said heating element thereby being immersed in said fluid heat transfer medium;

(b) fluid flow lines connected to said apparatus vessel of said heat exchange means and said system vessel for communicating refrigerant therebetween;

(c) pump means connected to said fluid flow lines for transferring a portion of said refrigerant from said system vessel to said chamber formed between said apparatus and inner vessels, wherein said portion of said refrigerant is heated by heat exchange relation with said inner vessel, and returning said heated portion of said refrigerant to said system vessel; and, (d) means for controlling the pressure and temperature of said refrigerant within said refrigeration system.

2. The apparatus of claim 1, wherein said heating element is provided longitudinally within said inner vessel.

3. The apparatus of claim 1, wherein said apparatus vessel has concentrically and axially positioned therein said inner vessel, said inner vessel having an electric coil of said heating element immersed in said fluid heat transfer medium therein and spaced apart baffles depending radially outwardly from said inner vessel for directing said refrigerant through said chamber and around said inner vessel.

4. The apparatus of claim 1, wherein said control means comprises means for selectively activating said pump means and said heating element.

5. The apparatus of claim 1, wherein said fluid flow lines include inlet and outlet piping connected to said system vessel, thereby creating a closed loop for said refrigerant.

6. The apparatus of claim 5, wherein said refrigerant flow in said inlet and outlet piping is manually controlled by valve means.

7. The apparatus of claim 5, wherein said inlet and outlet piping are removably connected to said system vessel and said heat exchange means.

8. An apparatus to aid in detecting refrigerant leaks in a refrigerant system of the type including an air-tight system vessel, refrigerant within said system vessel, a closed loop of fluid flow lines to allow flow of said refrigerant through heat transfer means, said apparatus comprising:

(a) an apparatus vessel connected to said system fluid flow lines, said apparatus vessel having an inner vessel therein, thereby forming a chamber therebetween, said inner vessel containing a fluid heat transfer medium and having a heating element immersed in said fluid medium;

(b) pump means for pumping a portion of said refrigerant from said system vessel through said fluid flow lines to said chamber formed between said apparatus and inner vessels and returning said portion of said refrigerant to said system vessel via said fluid flow lines;

(c) means for heating said portion of said refrigerant within said chamber by heat exchange relation with said inner vessel, thereby transferring heat to said refrigerant within said system vessel when said portion of said refrigerant is returned from said apparatus vessel to said system vessel via said fluid flow lines and to cause the pressure of said refrigerant within said system vessel to increase; and, (d) means for controlling the temperature of said refrigerant and the increase in pressure of said refrigerant within said system vessel.

9. The apparatus of claim 8, in which said apparatus vessel includes means for a connection to said fluid flow lines and for allowing said refrigerant to flow therethrough, said chamber being connected to said fluid flow lines for receiving said refrigerant, said heat transfer medium being provided in said inner vessel for heating said refrigerant within said chamber.

10. The apparatus of claim 9, wherein said inner vessel has a heating element extending longitudinally and axially therein.

11. The apparatus of claim 10, wherein said control means includes temperature actuated switch means for activating and deactivating said heating element of said heat transfer means in response to the temperature of said refrigerant within said chamber of said apparatus vessel.

12. The apparatus of claim 11, wherein said control means includes a second temperature actuated switch means for activating and deactivating said heating element of said heat exchange means in response to the temperature of said refrigerant flowing into said chamber of said apparatus vessel.

13. The apparatus of claim 12, wherein said control means includes pressure actuated switch means for activating and deactivating said pumping means and said heating element of said heat transfer means in response to the pressure of said refrigerant within said system vessel.

14. The apparatus of claim 13, in which said control means includes pressure gauge means for indicating the pressure of said refrigerant flowing into said chamber of said apparatus vessel.

15. The apparatus of claim 14, in which said control means includes a second pressure gauge means for indicating the pressure of said refrigerant flowing from said chamber of said apparatus vessel.

16. The apparatus of claim 15, in which said control means includes a relief valve means associated with said chamber of said apparatus vessel for allowing said refrigerant to escape from said chamber of said apparatus vessel if the pressure of said refrigerant within said chamber of said apparatus vessel is above a predetermined amount.

17. The apparatus of claim 16, in which said control means includes valve means associated with said fluid flow lines for controlling the flow of said refrigerant through said flow lines.

18. A method of heating a refrigerant in a refrigeration system including a system vessel having said refrigerant therein, comprising the steps of:

(a) removing a portion of said refrigerant from said system vessel;

(b) transporting said removed portion of refrigerant to heat exchange means;

(c) heating said refrigerant within the inner vessel of said heat exchange means, said heat exchange means comprising:

i. an apparatus vessel having said inner vessel therein, thereby forming a chamber therebetween, said inner vessel containing a fluid heat transfer medium therein; and, ii. a heating element provided in said inner vessel, said heating element thereby being immersed in said fluid heat transfer medium;

(d) returning said heated refrigerant to said system vessel; and, (e) controlling the temperature of said refrigerant flowing into and from said heat exchange means.

19. The method of claim 18, further comprising the step of controlling the pressure of said refrigerant within said system vessel.

20. The method of claim 19, wherein the step of heating said refrigerant includes directing said refrigerant through said chamber in heat transfer relation with said inner vessel having therein said heating element, said heating element including an electric coil immersed in said fluid heat transfer medium.

21. The method of claim 19, further comprising the step of selectively activating said means for transporting said refrigerant to said heat exchanger.

22. The method of claim 20, wherein said means for controlling the transport of said refrigerant to said heat exchanger includes pump means connected intermediate said system vessel and said heat exchanger means.

23. The method of claim 22, wherein said means for controlling the transport of said refrigerant to said heat exchange means further includes valve means positioned intermediate said system vessel and said heat exchange means.

24. A method of detecting refrigerant leaks in a refrigerant system of the type including an air-tight system vessel, refrigerant within said system vessel, closed loop fluid flow lines connecting said system vessel and heat exchange means, said method comprising the steps of:

(a) pumping a portion of said refrigerant from said system vessel through said fluid flow lines to an apparatus vessel;

(b) heating said refrigerant within the inner vessel of said apparatus vessel, said apparatus vessel having said inner vessel therein, thereby forming a chamber therebetween, said inner vessel containing a fluid heat transfer medium and having a heating element immersed in said fluid medium;

(c) controlling the temperature of said portion of said refrigerant within said apparatus vessel;

(d) pumping said portion of said refrigerant from said apparatus vessel to said system vessel; and, (e) controlling the increase in pressure of said refrigerant within said system vessel.

* * * * *